US007100405B2

(12) United States Patent
West

(10) Patent No.: US 7,100,405 B2
(45) Date of Patent: Sep. 5, 2006

(54) LATCHING DEVICES FOR GATES AND DOORS

(75) Inventor: James David Francis West, Terrey Hills (AU)

(73) Assignee: D&D Group Party Limited, Brookvale (GB)

( * ) Notice: Subject to any disclaimer, the term of this patent is extended or adjusted under 35 U.S.C. 154(b) by 0 days.

(21) Appl. No.: 10/504,006

(22) PCT Filed: Feb. 7, 2003

(86) PCT No.: PCT/AU03/00124

§ 371 (c)(1),
(2), (4) Date: Aug. 6, 2004

(87) PCT Pub. No.: WO03/067004

PCT Pub. Date: Aug. 14, 2003

(65) Prior Publication Data

US 2005/0199025 A1 Sep. 15, 2005

(30) Foreign Application Priority Data

Feb. 8, 2002 (AU) ..... PS0391

(51) Int. Cl.
*E05B 65/08* (2006.01)
*E05B 63/22* (2006.01)

(52) U.S. Cl. ..... 70/100; 70/DIG. 20; 292/DIG. 37; 292/13

(58) Field of Classification Search ..... 292/144, 292/251.5, 53, 227, 237, DIG. 15, DIG. 30, 292/13; 70/360, 361, 208, 102, DIG. 27, 70/DIG. 20, 104, 118, 154, DIG. 63, DIG. 70, 70/134, 124; 49/463, 394, 55, 57
See application file for complete search history.

(56) References Cited

U.S. PATENT DOCUMENTS

| | | | | | |
|---|---|---|---|---|---|
| 911,175 | A | * | 2/1909 | Stevenson et al. | 292/94 |
| 1,071,058 | A | * | 8/1913 | Kirkpatrick | 292/233 |
| 1,204,072 | A | * | 11/1916 | Royack | 292/94 |
| 1,302,409 | A | * | 4/1919 | Murphy | 49/449 |
| 1,495,370 | A | * | 5/1924 | Witten | 70/154 |
| 1,570,603 | A | * | 1/1926 | Holda | 292/164 |
| 3,055,204 | A | | 9/1962 | Pelcin | |

(Continued)

FOREIGN PATENT DOCUMENTS

CH 175957 3/1935

(Continued)

*Primary Examiner*—Brian Glessner
*Assistant Examiner*—William Schrode
(74) *Attorney, Agent, or Firm*—Kelly Lowry & Kelley, LLP

(57) ABSTRACT

A latching device (1) particularly for installation such as swimming pool gates may have an automatic magnetic latch with a child resistant device to control access. The child resistant device may include an operating handle (10) at an elevated location to be out of the reach of the child and an alternative operating device (11) is provided at a lower location with child resistance provided typically by a push button arrangement (12) acting through a cam and cam follower to raise a latching arm (3) against the biasing to the latching position. A simple pronged key (16) for a pushing action can be provided, but another aspect consists in a mechanically actuatable key pad (20) which can readily be operated by an adult even in a wheelchair, but which is resistant to child actuation. For example, a selected two of eight buttons may be required to be depressed to permit the key to actuate the push button.

30 Claims, 11 Drawing Sheets

U.S. PATENT DOCUMENTS

| | | | | |
|---|---|---|---|---|
| 3,890,814 | A | 6/1975 | Fantoni | |
| 5,217,265 | A | 6/1993 | Lerner | |
| 5,362,116 | A * | 11/1994 | Doyle et al. | 292/144 |
| 5,664,769 | A * | 9/1997 | Sadinsky et al. | 256/73 |
| 6,499,254 | B1 * | 12/2002 | Rossman et al. | 49/55 |
| 6,666,435 | B1 * | 3/2003 | Blosfelds | 256/73 |
| 2002/0008388 | A1 | 1/2002 | Gleason | |
| 2003/0041632 | A1 * | 3/2003 | Del Nin | 70/93 |
| 2005/0210938 | A1 * | 9/2005 | Doyle et al. | 70/276 |
| 2005/0225098 | A1 * | 10/2005 | Kliefoth et al. | 292/251.5 |

FOREIGN PATENT DOCUMENTS

| | | |
|---|---|---|
| GB | 1197893 | 7/1970 |

* cited by examiner

LATCHING DEVICES FOR GATES AND DOORS

FIELD OF THE INVENTION

The present invention relates to securing arrangements for gates and doors, and includes devices for latching and optionally locking gates and doors.

Some important applications of the invention are to installations particularly concerned with child resistant latching devices.

The present invention will be exemplified with reference to the particular problem of hinged swimming pool gates which require secure automatic latching on closure and the ability to prevent young children unlatching and opening the gate, but it is to be understood that the invention extends to embodiments intended for other applications including sliding doors and other structures.

Furthermore other aspects of the invention extend to new key and key controlled latching mechanisms for gates and doors where security is to be provided.

BACKGROUND OF THE INVENTION

As an illustration of one field of application of some embodiments of the invention, the issue of child resistant latches for swimming pool gates will be discussed.

To prevent young children from entering a pool area without supervision, safety pool fences are usually required by law. These safety pool fences include a self-latching device which is arranged to operate automatically on closing the gate of the fence and prevents the gate from being reopened without manual releasing of the mechanism. Usually a self-closing mechanism such as spring hinges is also provided on the gate to bias the gate to a closed position.

The present applicants are the owners of, U.S. Pat. No. 5,362,116 which discloses a safety latch in the form of a self-latching magnetic latching device. This comprises a latch arm and housing which in use is arranged to extend vertically, mounted to a gatepost. One end of the latch arm is arranged to engage with a retaining element mounted to the gate, to prevent opening of the gate. The latch arm is displaceable from an extended position where it engages with the retaining element to a retracted position so that the gate may be opened. The device includes an operating mechanism which includes an actuator in the form of a know manipulable by a user to displace the latch arm to the retracted position. The knob is placed remotely from the end of the latch arm which engages with the retaining element, at the top of the latch arm housing. In use, the knob is positioned so that only a standing adult can reach it. This prevents children from being able to actuate the knob and operate the latch device.

One limitation with this arrangement is that, while the device cannot be operated by children (as intended), it also cannot be operated by persons who should be allowed entry to the pool but cannot reach the knob because, for example, they may be disabled, in a wheelchair and therefore unable to stand. There are also various laws in various countries and states which require that disabled people have access to areas where able people can go, including swimming pools.

It would therefore be desirable if a latching device could be operated by adults including disabled people while still preventing access to restricted areas by children.

Furthermore, alternatives to known gate latching devices and key-lock arrangements for such devices would be desirable.

SUMMARY OF THE INVENTION

The present invention in one embodiment provides a latching device for latching, in a predetermined position, two members which are otherwise moveable relative to one another, the latching device having (a) a retaining element adapted to be mounted to a first of the members, (b) a mounting structure arranged to be mounted on a second of the members (c) a latch arm mounted on the mounting structure and arranged in use, when in an engaged position, to engage with the retaining element to prevent relative movement of the members, (d) the latch arm being displaceable to a disengaged position so that the members may be moved apart, the latching device further comprising (e) a first operating mechanism for displacing the latch arm to the disengaged position, the first operating mechanism including a first actuator manipulatable by a user to displace the latch arm to the disengaged position, the first actuator being positionable in use at a first height accessible by a standing adult user, and (f) a second operating mechanism for displacing the latch arm to the disengaged position, the second operating mechanism including a second actuator manipulatable by an adult user to displace the latch arm to the disengaged position, the second actuator being positionable in use at a second height, lower than the first height, and accessible by a seated adult, such as a disabled person in a wheelchair.

This new concept can be applied as a modification to the device of U.S. Pat. No. 5,362,116, and incorporates means to make the installation child-resistant to opening from a lower location which is inherently child accessible.

In the engaged position the latch arm may be in an extended position and in the disengaged position the latch arm may be in a retracted position.

The members may be a gate and gatepost (eg allowing access to a swimming pool area) or any door jamb and door arrangement for access to any area In one embodiment a key is required to operate the second actuator.

To prevent access to unauthorised person, such as children, therefore, the key may be presented to the person requiring it when they request access to the area.

A useful embodiment is one where the key is arranged to be mounted proximate the latching device for ease of access. To prevent operation by, for example, children, the key can be arranged to be set to an inoperable state where it cannot be used and to an operable state where it can be used. The key may include security means, operation of the security means being required to set the key to the enabled state.

The security means can include a keypad, and to operate the security means to set the key to the enabled state a code must be entered by way of the keypad.

In one embodiment, the security means further includes a shroud or cover member which is arranged to cover an operating portion of the key, when the key is in the disabled state, and withdrawing of the cover member from the operating portion sets the key in the enabled state. The cover member can only be withdrawn when the security code is entered.

The second operating mechanism may includes a further actuator, which is arranged to be positioned on the opposite side of the one member from the second actuator, so that the second operating mechanism can be operated from either side of the one member.

In a useful embodiment, the second actuator is a push button. The latch arm in use may extend vertically and be arranged to be extended and retracted in a vertical direction.

The push button can be arranged to be pushed inwardly in a horizontal direction and the second operating mechanism can include a cam operated by the push button and a cam follower. On operation of the cam the cam follower operates on the latch arm to raise it to the retracted position.

In another aspect, the present invention provides for an alternative approach to a latching device which does not necessarily incorporate the first actuator positioned at a height not accessible to a child but only to a standing adult. The features of this specific aspect may be combined with the features of a latching device according to the first aspect of the invention but may be otherwise applied, for example to a key-controlled push button actuator which uses a cam and cam follower arrangement. Usually the push button has a horizontal axially directed line of actuation when unlocked and the cam follower displaces a latching arm along an axis at right angles to the line of actuation of the push button. Optionally this aspect of the invention may extend to a complimentary remote actuator push button adapted to be mounted on the opposite side of the first member to that of the first push button. Axially alignment of the push buttons can be achieved with independent unlatching functions so that, for example, the second push button could be located on the interior of eg a swimming pool enclosure to facilitate actuation and release of the latching mechanism so the gate or door can be opened irrespective whether the first push button is locked or not.

In a broad form and more fully the second aspect of the invention may be defined as providing a latching device for latching in a predetermined position, two members which are otherwise moveable relative to one another, the latching device having (a) a retaining element adapted to be mounted to a first of the members, (b) a mounting structure arranged to be mounted on the second of the members, (c) the mounting structure having a latch arm arranged to be mounted in a housing for engagement when in use in an engaged position with the retaining element to prevent relative movement of the members, (d) the latch arm being displaceable to a disengaged position so that the members may be moved apart, (e) an operating mechanism including a push button actuator having an axis of actuation along which it is adapted to be pushed against biasing means to displace the latch arm substantially at right angles to the axis of actuation to the disengaged position, (f) the operating mechanism including a locking mechanism adapted to be operated by an adult, which locks the push button actuator in a first position until the locking mechanism is released, and characterised by the operating mechanism including a cam element operated by the push button actuator, and a cam follower connected to the latching arm to displace it responsive to movement of the cam.

A third inventive aspect of the present disclosure relates to a novel form of key particularly adapted to be used advantageously with latching devices described herein as other aspects of the invention.

This aspect provides a key for operating a locking mechanism, wherein the key is arranged to be normally set to a disabled state where it cannot be used and capable of adult manipulation to an enabled state where it can be used, the key including a security means, operation of which by adult manipulation sets the key to the enabled state.

In one form the key is based on a concept of a simple prong which is inserted into a complimentary groove in a lock extending into the push button device thereby releasing the push button from a locked condition so that it may be pressed inwardly to release the latching arm. In a simple form this key is adapted to be carried by an authorised person and thereby a child resistant actuator is provided without being high security installation such as that that would be provided by a cylinder lock.

However in a more sophisticated form a key device can be secured to the structure near the latching device eg by being suspended with a security device intended to be actuated by an adult and not a child. For example this form of device can have a simple prong arrangement which is enshrouded and the shroud is adapted to be retracted on actuation of a key pad when an adult presses the correct combination of keys so that the prongs can be inserted to unlock the locking mechanism of the push button. The prong can then be withdrawn and the shrouding would then move back eg under spring biasing to its original position so that the key can be left hanging near the latch device but would not be capable of actuation by a young child.

A preferred mode of operation is for the device to be held in the palm of one hand with two fingers extending either side of the shroud. Fingers of the other hand key in the "code" to depress the relevant keys and the two fingers engage around and retract the shroud so the prongs are exposed to release the locking mechanism.

Thus this aspect of the invention provides a new and useful alternative to known digital lock arrangements.

With advantage all aspects of the invention can be combined in a single list installation but the present specification presents these aspects as distinct alternative proposals which may be used and provide a novel arrangement singly or in any combination.

BRIEF DESCRIPTION OF THE DRAWINGS

Features and advantages of the present invention will become apparent from the following description of an embodiment thereof, by way of example only, with reference to the accompanying drawings, in which.

DESCRIPTION OF PREFERRED EMBODIMENT

Figure 1:
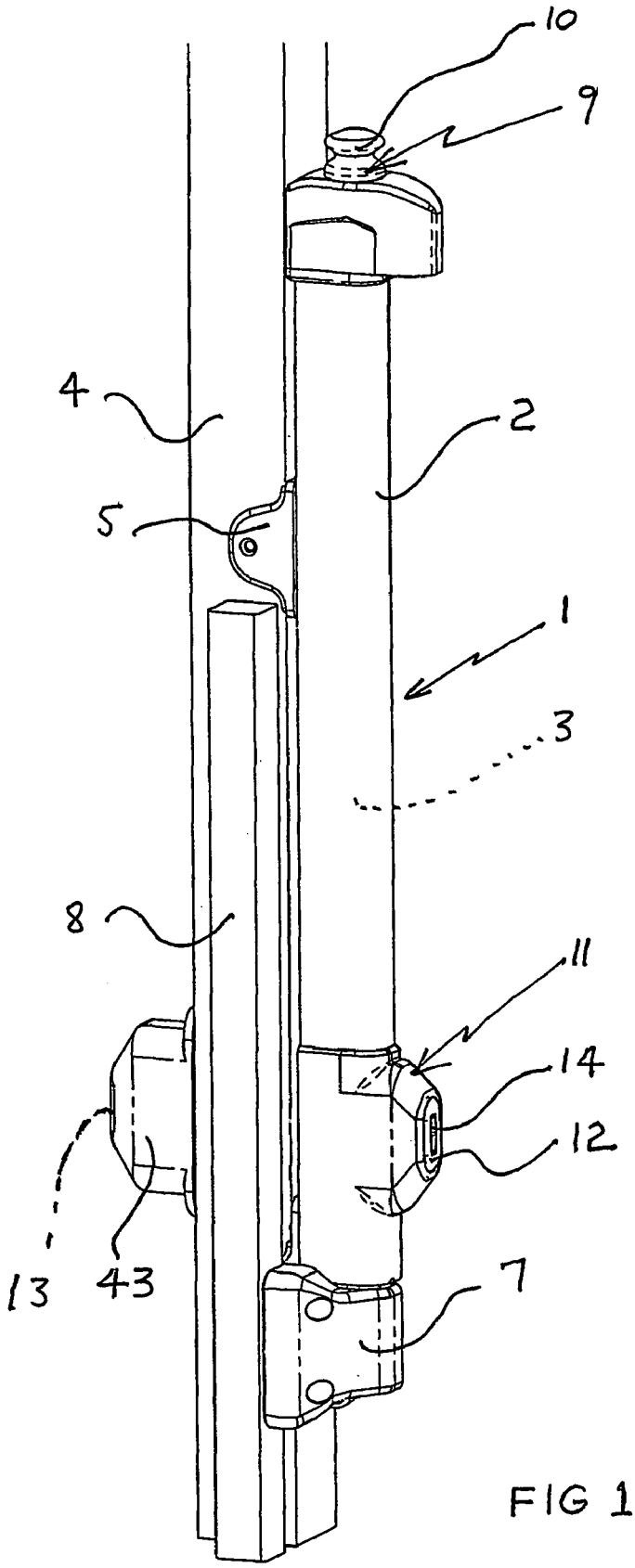
FIG. 1 is a perspective view of a latching device installed on a gate post, for example for a swimming pool enclosure, with a retaining device installed on a frame of the gate.

Referring to the drawings, a latch device 1 has a housing 2 which mounts internally a latch arm 3, comprising in this example a number of components which will be described in more detail later. In this embodiment, in use the housing is mounted to a gatepost 4, by way of mounting flanges of brackets 5 which permit the housing 2 to be adjusted in height during installation.

The latch arm 3 is moveable between an extended position and a retracted position. In the extended position of FIG. 1 and FIG. 6 a bolt 6 having a tip 6A of the latch arm 3 extends into a retaining member 7 (which would be similar to the retaining member used in the applicant's above referenced US Patent), which is fitted to a gate frame 8 as shown in FIG. 1. The retaining member 7 includes a latching shoulder which, when the latch arm 3 is in the extended position interferes with the bolt 6 and prevents relative movement (eg stops the gate from being opened). In this embodiment a strong magnet in the retaining member pulls the bolt tip 6A down to align with the latching shoulder. In latching, the device 1 operates in a similar manner to the device disclosed in the applicants' earlier U.S. Pat. No. 5,362,116. The device 1 operates as a self-latching device, which is positively biased to operate by way of a magnetic field when the latch arm 3 and retaining member are axially aligned. No manipulation by the user is required for this to occur, since latching happens automatically when the retaining member and bolt 6 are axially aligned usually as a result of a closing mechanism moving the gate to the closed position.

In order to unlatch the device 1, first and second operating mechanisms are provided. The first operating mechanism is similar to that disclosed in U.S. Pat. No. 5,362,116 and comprises a first actuator 9, having an operating handle 10, which is mounted at the top of the elongate housing 2 and connected to the latch arm 3. A user pulls the handle and this causes the latch arm 3 to lift upwardly into the retracted position, (shown also in FIG. 7 when the alternative operating mechanism is used) so that the bolt tip 6A is removed from the retaining member 7. The gate can then be opened. Because the handle is positioned at the top of the elongate housing 2, and the elongate housing is mounted at a predetermined height, the height of the handle is such that it can only be operated by an adult user. The positioning of the housing 2 would be such that the handle could not be reached by a child.

Such a handle, of course, cannot be reached by somebody who is disabled and has to use a wheelchair. This presents a problem for disabled people. This embodiment of the present invention addressed this problem by using a second operating mechanism 11, having an actuating member which in this example is in the form of a first push button 12 and a rear second push button 13. When either push button is pushed in, the latch arm 3 is raised to the retracted position (by operation of a cam structure described below), thereby removing the bolt tip 6A from the retaining member. Each push button is accessible at a lower height than the handle actuator, and can be accessed by, for example, a person sitting in a wheelchair.

Obviously, this presents a problem, in that if it can be accessed by a person in a wheelchair, a push button can be accessed by a child. To avoid a child being able to actuate the push button, a lock and key system is provided at least for the outer or first push button which will be outside a swimming pool gate. Locking from the gate interior may not be needed. In the illustrated embodiment, each push button has an associated lock which includes a key access groove 14.

Figure 11:
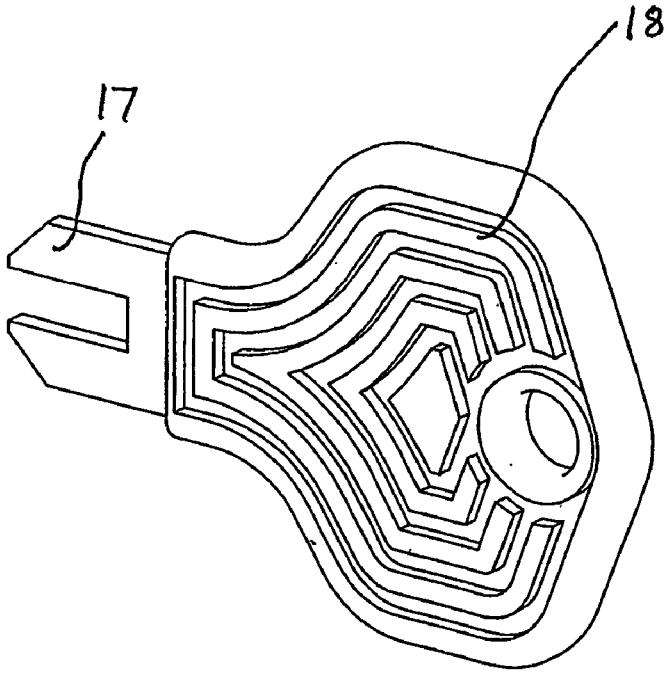
FIG. 11 is a view of the key arranged to operate the locking mechanism of the device of FIG. 1.

The simplest form of key 16 is shown in FIG. 11 and comprises a ribbed handle 18 and a forked operating tip 17 having prongs for insertion into the key groove 14 in the push button 12. The mechanism is unlocked by this action before the push button can be operated. Such a key 16 is intended to be entrusted to an adult who retains the key in safe possession. However, issuing such a key to an adult can at times be inconvenient.

In another embodiment, a key 20 (FIGS. 12 to 15) is provided and which is to be mounted proximate the latching device 1 by way of a mounting bracket.

Figure 12:
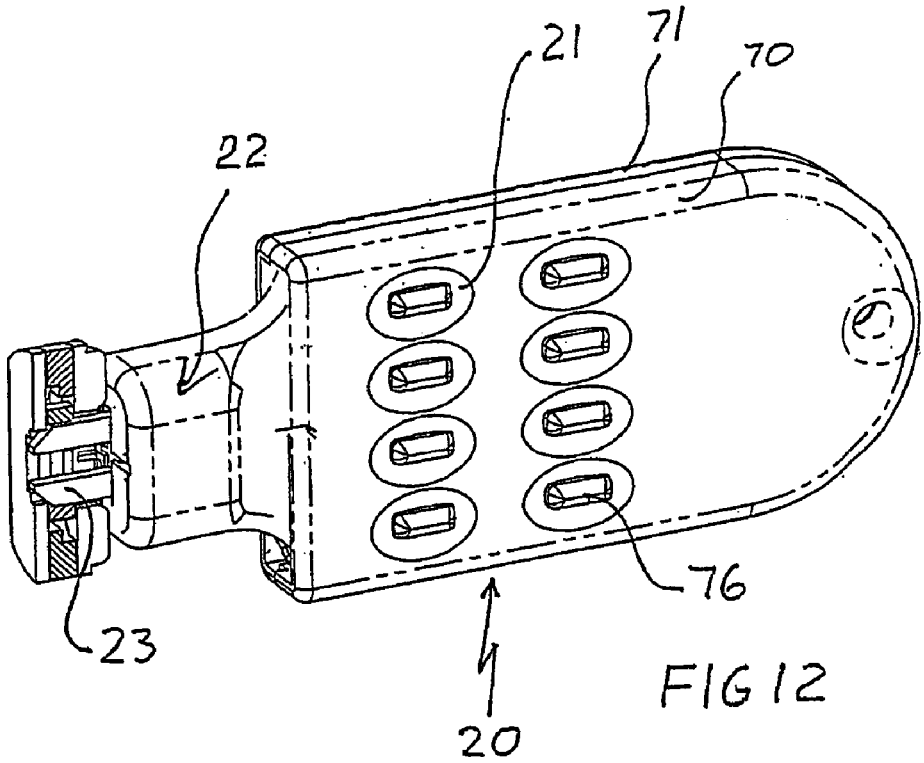
FIG. 12 is a perspective view of an enlarged scale of another form of key shown fitting into the lock of the button of FIGS. 9 and 10.

In order to prevent unauthorised operation of the key 20 a security arrangement is provided. FIG. 12 shows an embodiment, having a keypad 21. To operate the key, a code must be entered on the key pad 21 which then enables a cover 2 to be withdrawn to expose a forked prong 23 for unlocking the push button. Fuller details of this alternative will be described in more detail later.

The latching device 1 and its operation will now be described in more detail.

The latch arm 3 comprises a number of components. It includes an upper portion comprising a rod 30 mounting the actuating handle 10 at its upper end an connected at its lower end through connector 31 to an upper link 32 and a lower link 33, which are slideably interengaged with each other within the housing 2 so that they will undergo motion relative to each other. The lower link 33 has a horizontal mounting plate 34 at its lower end to which upper end of the bolt 6 is fixed.

Figure 5:
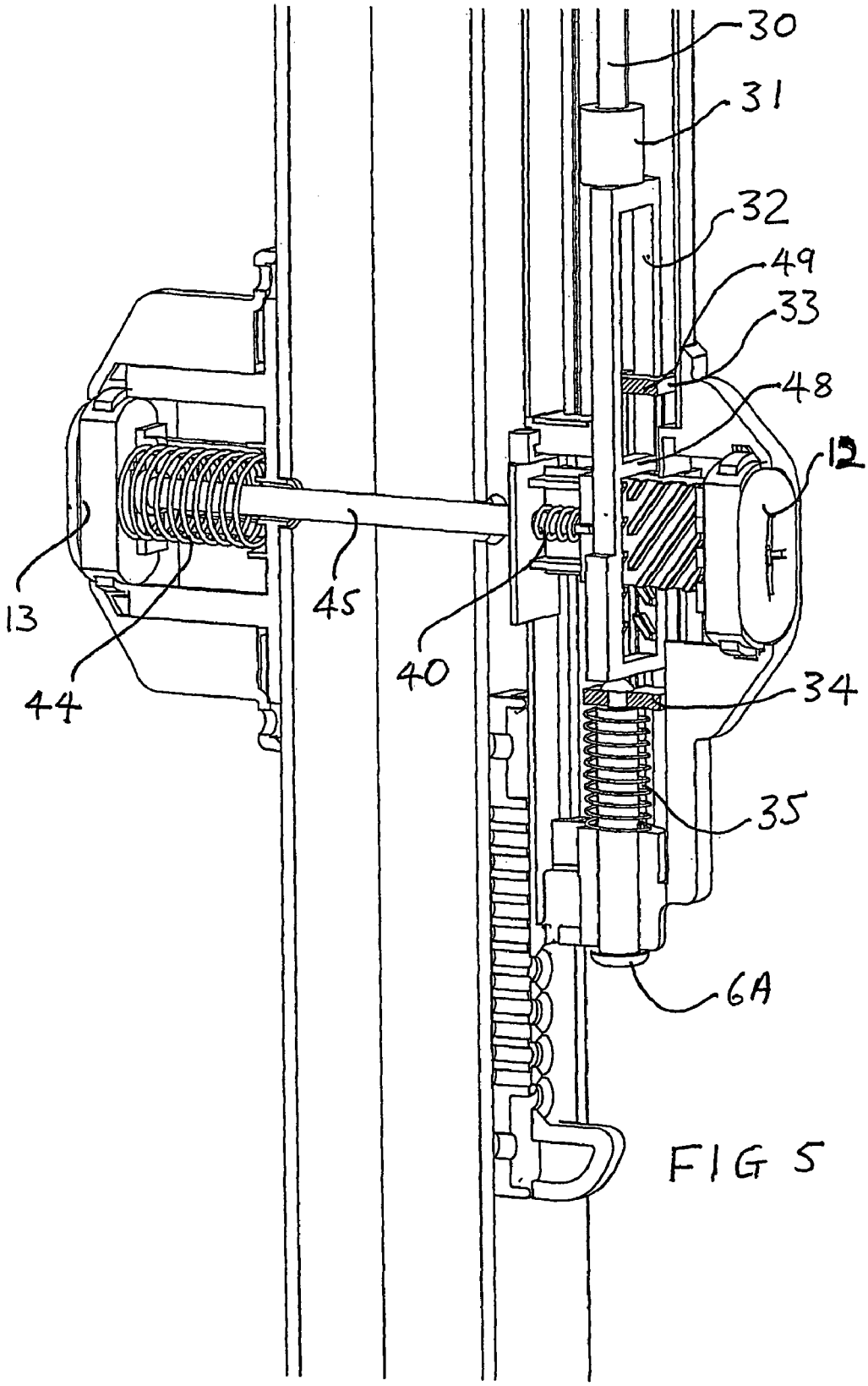
FIG. 5 is a part cross-sectional isometric view of the latching device of FIG. 1 corresponding to open gate position and each opening device released.
Figure 6:
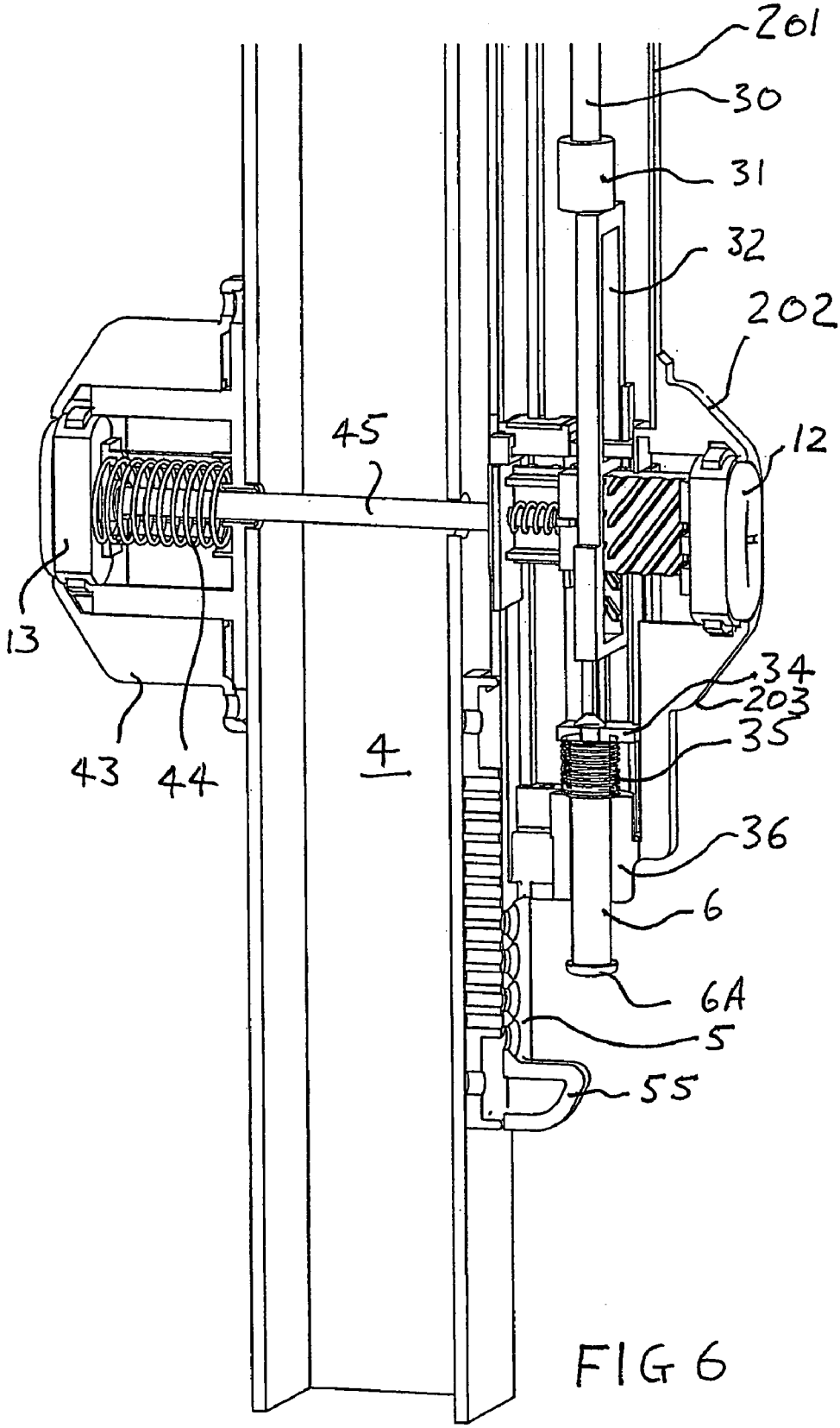
FIG. 6 shows the latching device of FIG. 1 in partial cross-section with parts of the housing removed for clarity and showing the device in a latching position in use, the latching bolt extended against its spring biasing to the position it will adopt when attracted by the strong magnetic forces in the retaining device.

FIG. 6 shows the bolt 6 in its extended latching position where it engages with the retaining member 7 due to magnetic attraction, thereby compressing a helical lifting spring 35 retained between the mounting plate 34 and a fixed collar 36 which forms part of the interior housing structure. When the handle 10 is lifted, the rod 30 moves with it as does the upper link 32 to which it is connected. After initial lost motion is taken up, the lower link at 33 is lifted along with the mounting plate 34, thereby lifting the bolt 6 to disengage from the retaining member so that the gate can be opened. When the handle 10 is released, the upper link 32 drops under gravity but the lower link 33 is retained in its elevated position by the spring 35 and the configuration shown in FIG. 5 remains.

In the alternative, actuation of the mechanism can be achieved by pressing either the front push button 12 or the rear push button 13 to act through a cam and cam follower arrangement which will now be described in detail.

The push button 12 abuts a cam plate 36 which includes on one face a series of parallel angled ribs 37 which form a slide cam. The cam plate 36 is arranged to move inwardly in a horizontal direction through a support aperture 37A in the interior frame 38 of the housing when the push button 12 is pushed in and the ribs 37 then engage with a cam follower arrangement formed by angled projections 39 on a portion of the upper link 32. A spring 40 is provided in order to return the cam plate 36 and push button 12 after the gate has been opened and the push button released.

The rear push button 13 is provided in a housing 43 mounted on the rear side of the gate post 4. The push button 13 pushes a push rod 45 which extends through the gate post 4 and abuts a further cam plate 46 which on the exterior right hand face (hidden in FIG. 6) carries a set of ribs angled appropriately to the ribs 26 for engaging with corresponding cam follower projections 47 on the inner right hand face of the upper link 31.

The rear push button 13 is mounted in a rear housing 43 to enable the latch mechanism to be operated from the rear side of the gate. A return spring 44 is provided to return the button 13 and push rod to a position where a cam is not engaged with the cam follower 47 and upper link 32. Spring 40 returns the cam plate 46 to its initial position.

FIG. 5 illustrates the second operating mechanism in the disengaged state with the latch 3 in the retracted position and corresponding to the gate having been opened after unlatching and the buttons or handle released so that a lifting shoulder 48 on upper link 32 is below the shoulder 49 on lower link 33.

Figure 3:
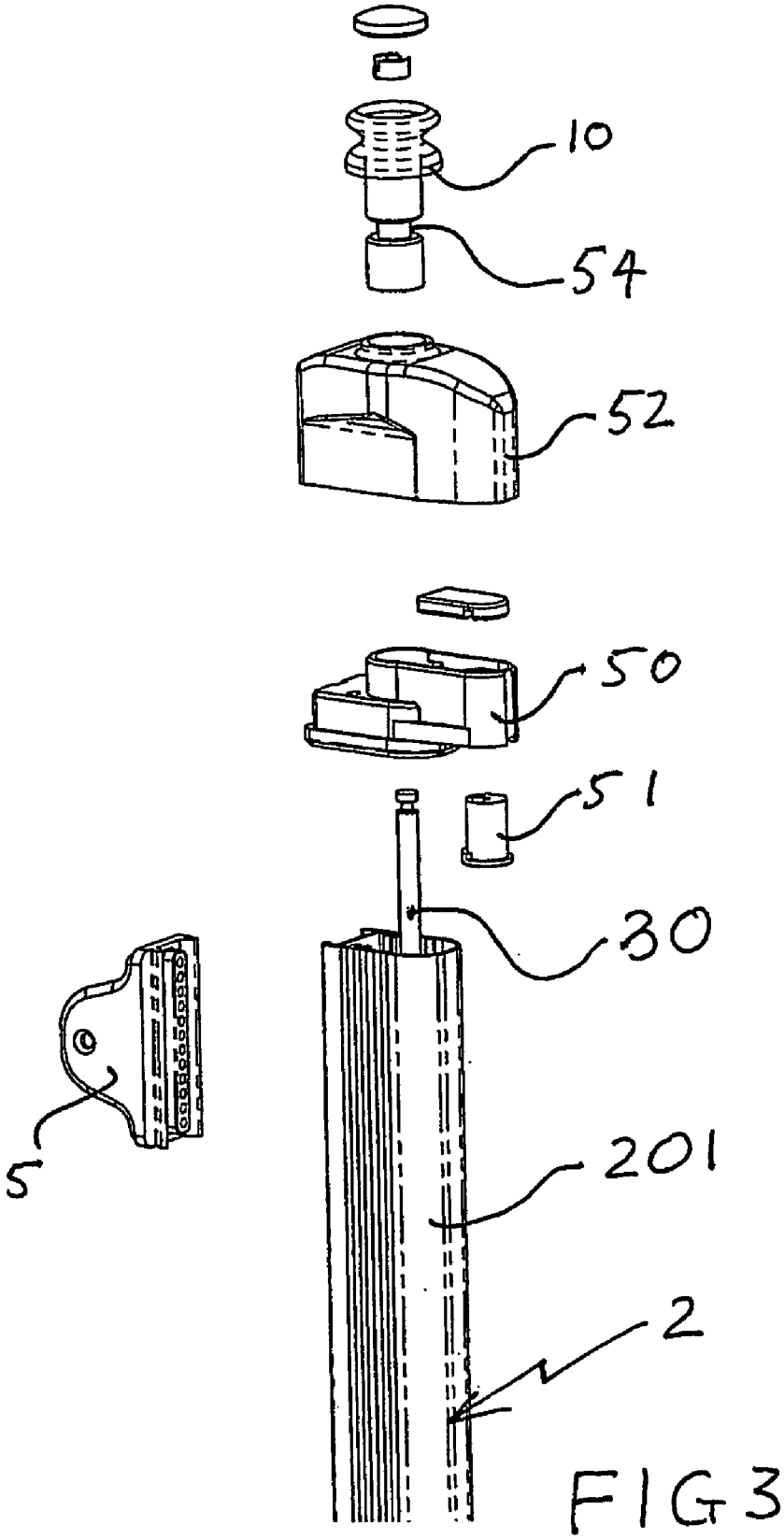
FIG. 3 is an exploded view of the upper portion of FIG. 1 showing the components of the upper actuating member.
Figure 4:
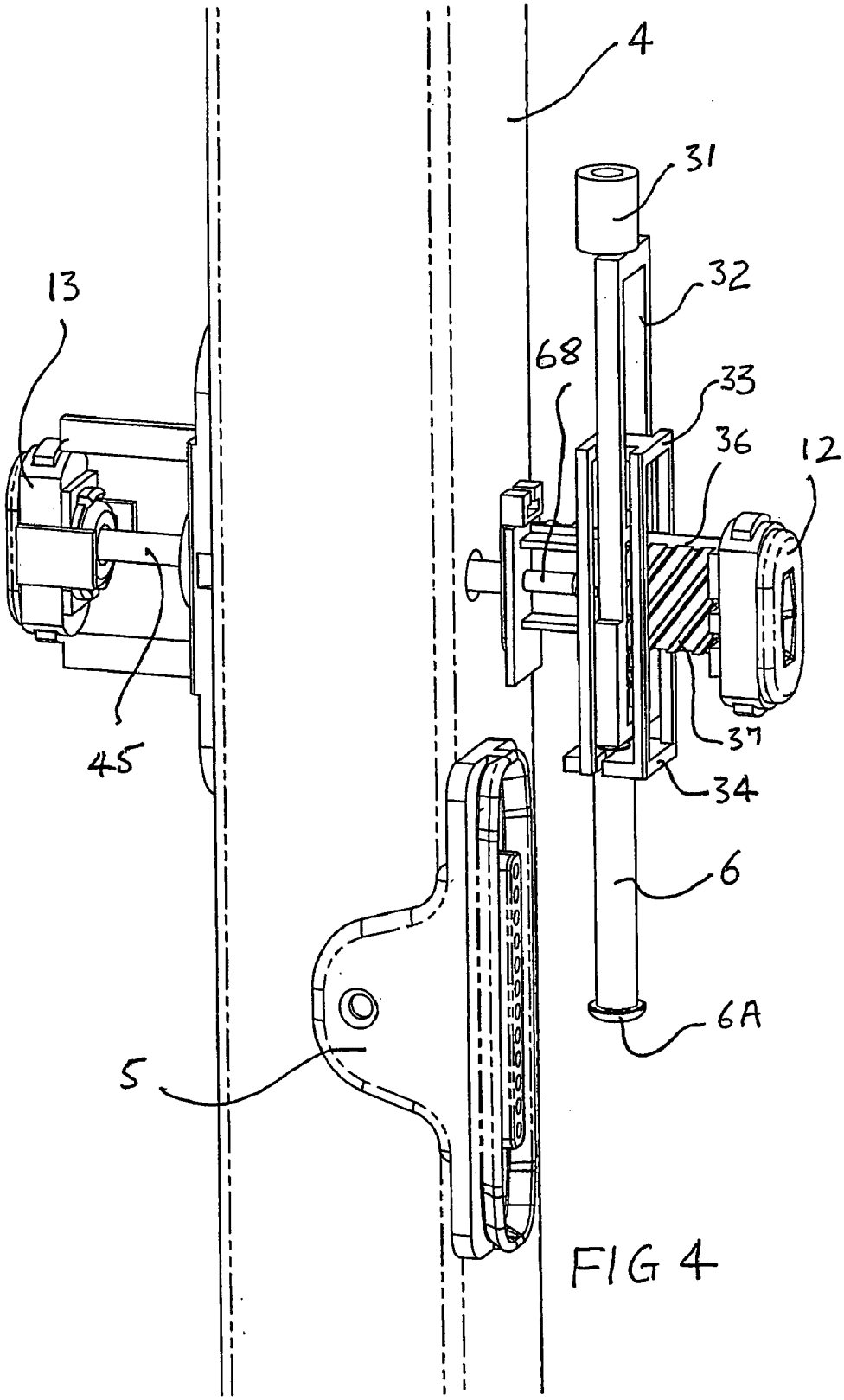
FIG. 4 is a partly assembled view showing interior components of the device of FIG. 1.

Details of the top portion of the device will now be described with reference to FIG. 3. The upper part of the housing 2 is in the form of a tubular extrusion 201 adapted to mount at its upper end a mount 50 for a lock 51 of a cylinder type with a top cover 52 being adapted to cover the mount 50. The arrangement permits the cylinder lock 51 to be actuated by a key, thereby preventing the handle 10 being lifted by virtue of the lock engaging with an annular groove 50 in the base of the handle so it cannot be lifted.

Figure 2:
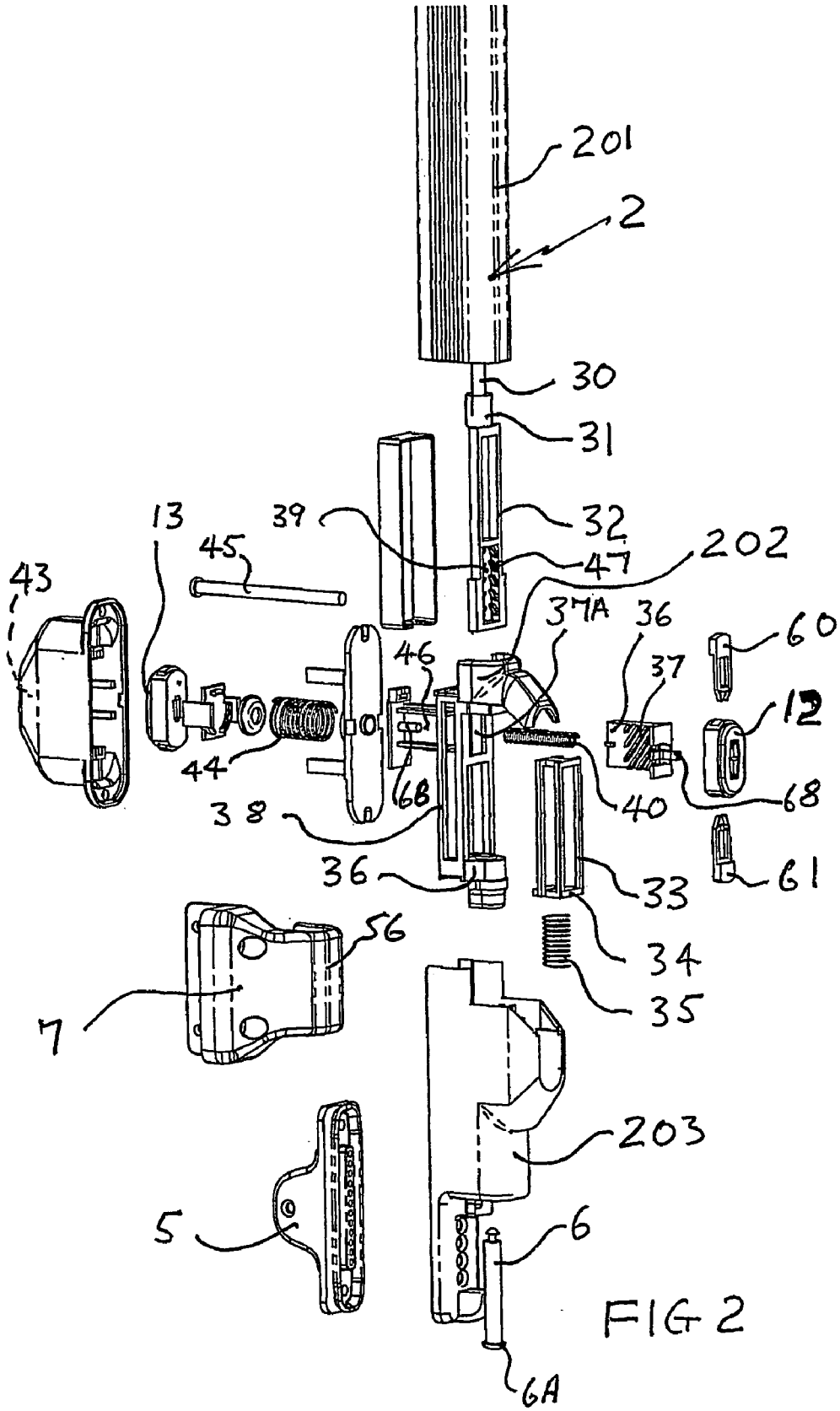
FIG. 2 is an exploded view of the lower portion of the device of FIG. 1 showing individual components.

Further structure for the housing is shown in FIG. 2 and includes the interior frame 38 having an upper exterior casing element 202 and a lower exterior casing 203. Although not shown in this embodiment, an adaptation is to provide a lost motion link between the connector 31 and the upper link 32 so that if the handle is locked with the cylinder lock, actuation is possible by either push button.

FIG. 6 shows the latch 3 in the extended position with the bolt tip 6A positioned where it would engage within a receiving cavity behind latching shoulders in the retainer member 7. FIG. 6 shows an abutment 55 from the lower mounting bracket 5 which prevents de-latching the mechanism by forcing the gate downwards.

Figure 7:
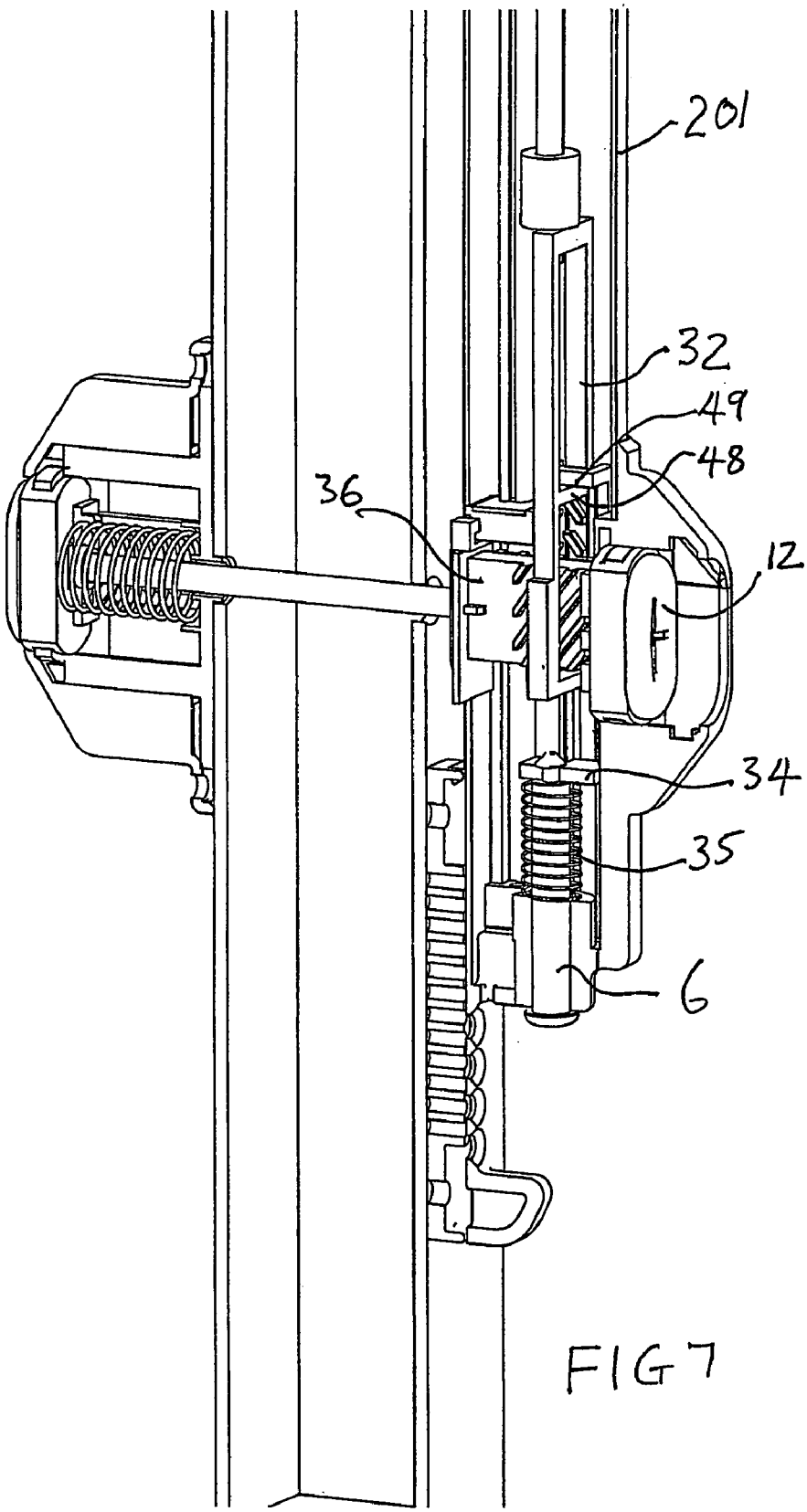
FIG. 7 is a view corresponding to FIG. 6 but showing the effect of actuation of, in this case, the exterior push button of the device so that the gate may be opened.

FIG. 7 shows the push button 12 in the depressed position, causing the first operating mechanism to be actuated, so that the upper link 32 is pushed upwardly, causing the shoulder 48 of the upper link to engage under the shoulder 49 of the lower link 33 thereby lifting the lower link which includes the mounting plate 34 whereby the bolt 6 is lifted and the extension spring 35 can extend. It will be noted that the front cam plate 36 has been pressed inwardly to compress the return spring 40 (not shown in FIG. 7) and with the push button held in, the gate can be opened. When the push button 12 is released, it springs back to its original position as shown in FIG. 5. However, operation of the push button in this embodiment is dependent upon the lock being first released as will be discussed in more detail below.

It will be appreciated that only one of the cam plates 36 or 46 is adapted to be depressed at a time and either will lift the links so that the bolt is retracted and held in an upper position despite downward magnetic forces from the retaining member so that the gate can be opened.

Figure 9:
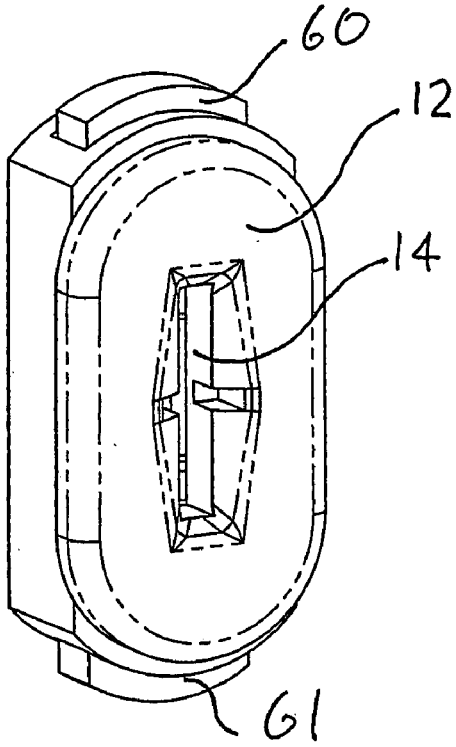
FIG. 9 is a detailed front view of a push button of an actuating mechanism of the device of FIG. 1.
Figure 10:
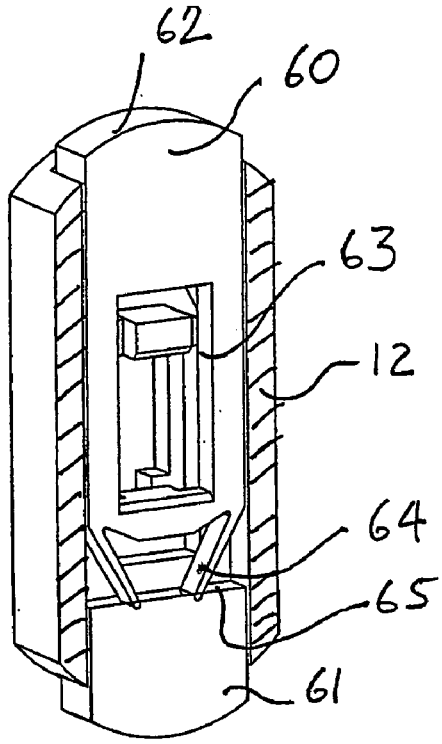
FIG. 10 is a sectional rear view of the push button of FIG. 9.

Operation of the locking mechanism will now be described. Most conveniently, FIG. 2 in exploded form shows the front push button 12 having a pair of complementary spring biased locking tabs 60 and 61 which are urged laterally in respective grooves in the upper and lower sides of the push button 12. FIGS. 9 and 10 show detail on an enlarged scale and in the part cross-sectional view of FIG. 10, detail of the tabs can be seen. Each tab is complementary and comprises a curved tip 62, a central aperture 63 and two inwardly directed spring legs 64. Conveniently, the tabs are moulded of plastic material. Each tab has a transverse shoulder 65 so that when assembled as shown in FIG. 10, each tab is spring biased away from each other to the locking position. To permit the push button, when assembled to be moved, the tabs are retracted by inserting a forked key, as described in more detail below, through groove 14 so that the tabs are pulled towards one another. As clearly shown for example in FIG. 8, the respective housings have interior recesses 66 into which the tabs normally engage to perform a locking function. For a swimming pool gate installation, it may be preferred for the rear push button 13 to be free from locking function in which case adaptation of the housing to elongate the recess 66 axially to the extent of push button travel would provide that freedom.

As described above, the simplest form of a key is shown in FIG. 11 with prongs 17 having respective angled ramp surfaces which engage on complementary structure on the tabs to retract them. Continued pressure conveniently through the key permits the push button to be displaced and thus the latching device disengaged to permit a gate to be opened.

Figure 8:
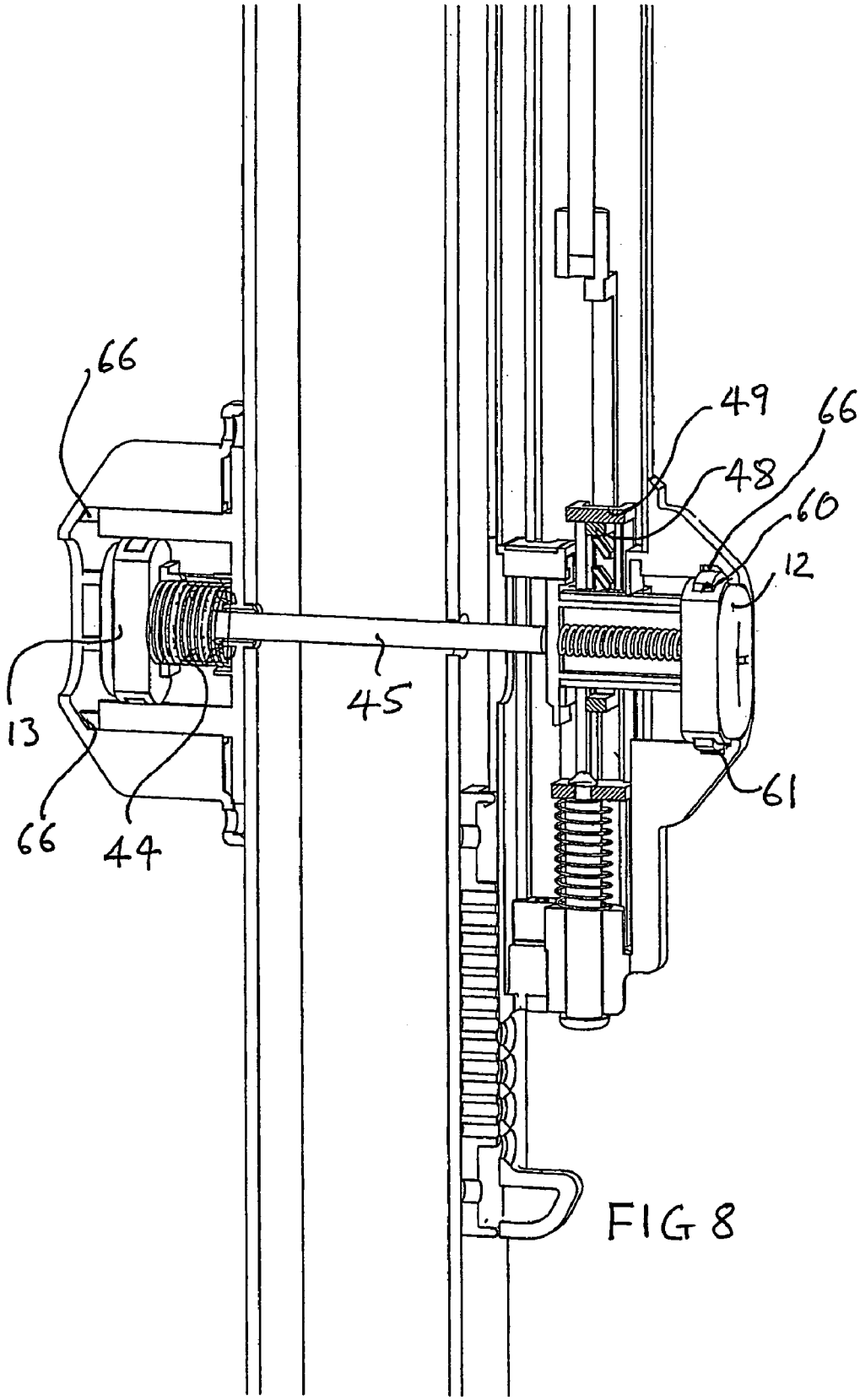
FIG. 8 is a view corresponding to FIG. 7 wherein the rear push button has been depressed and the gate is open, the bolt being retained in a elevated position by its biasing helical spring after the rear push button is released.

FIG. 8 illustrates the rear push button 13 in a depressed position, causing the second operating mechanism to operate and again the shoulder 48 is engaged with the shoulder 49, thereby lifting the lower link 33.

As best shown in FIG. 2, a projection 68 on an end face of cam plate 36, is arranged, when push button 12 is pushed inwardly, to extend into the groove 14 from the opposite direction from the key. This projection 68 is shaped to fit in the central area between the prongs of the key. This arrangement prevents the lock being actuated by a simple rectangular or rounded flat member, such as a stick.

Figure 13:
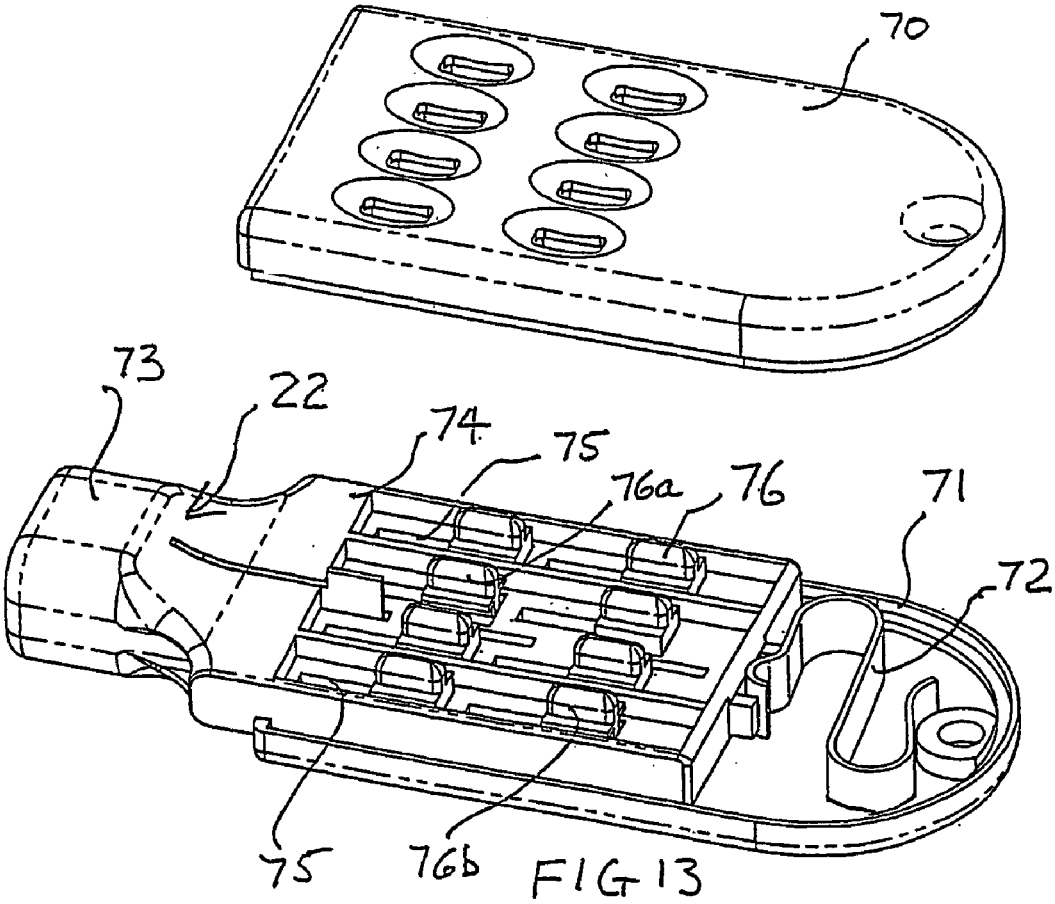
FIG. 13 is an exploded view of the key of FIG. 12, showing internal components.

Referring to FIGS. 12 to 15, the key 20 comprises a housing having an upper cover 70 and a lower cover 71. Shroud 22 is mounted within the housing so that it is slideable within the housing between a retracted position, where the prongs 23 are revealed (see FIG. 12) and the key can be operated and an extended position where the prongs 23 are hidden by the shroud and the key is not operable (FIG. 13). A spring 72 mounted within the housing biases the shroud 22 to the outward, non-operable position.

Figure 14:
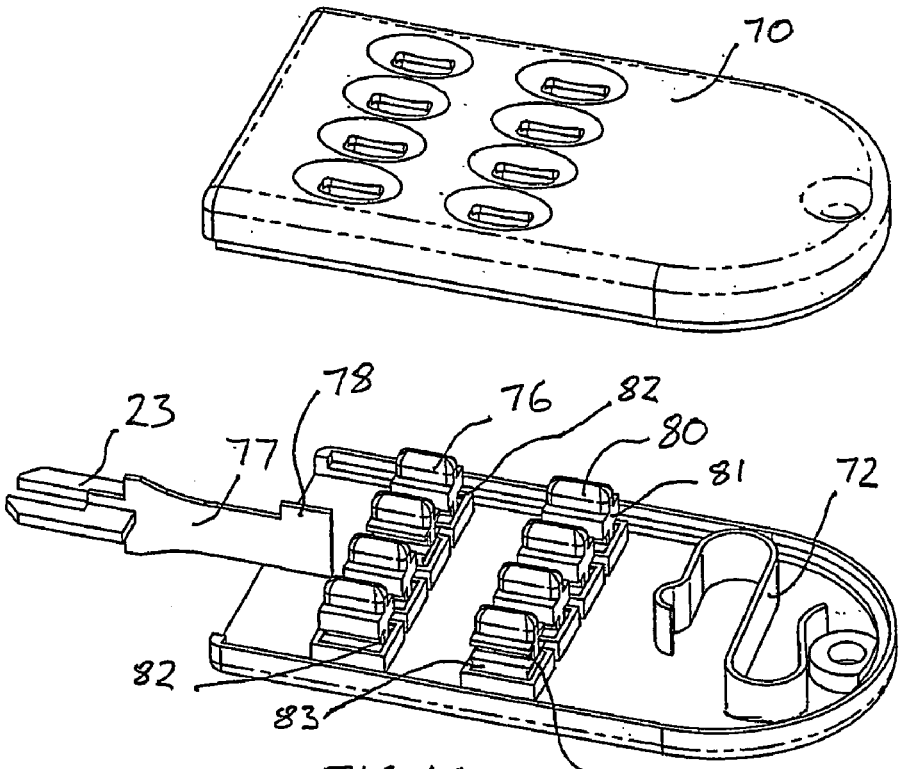
FIG. 14 is a further exploded view of the key of FIG. 12.

The shroud 22 comprises a forward cover portion 73 (which operates to cover the prongs 23) and an inner slide portion 74 which includes array of slots 75 which receive keys 76 of the key pad 21. The keys 76 are arranged to be actuated by a user by pressing them downwardly. The partly disassembled view of FIG. 14 shows the slideable shroud removed and depicting how the prongs 23 are mounted on a spine 77 terminating in an upper tab 78 and a lower tab 79 shown in FIG. 15 which anchor the prongs in respective grooves in the upper and lower housings.

Figure 15:
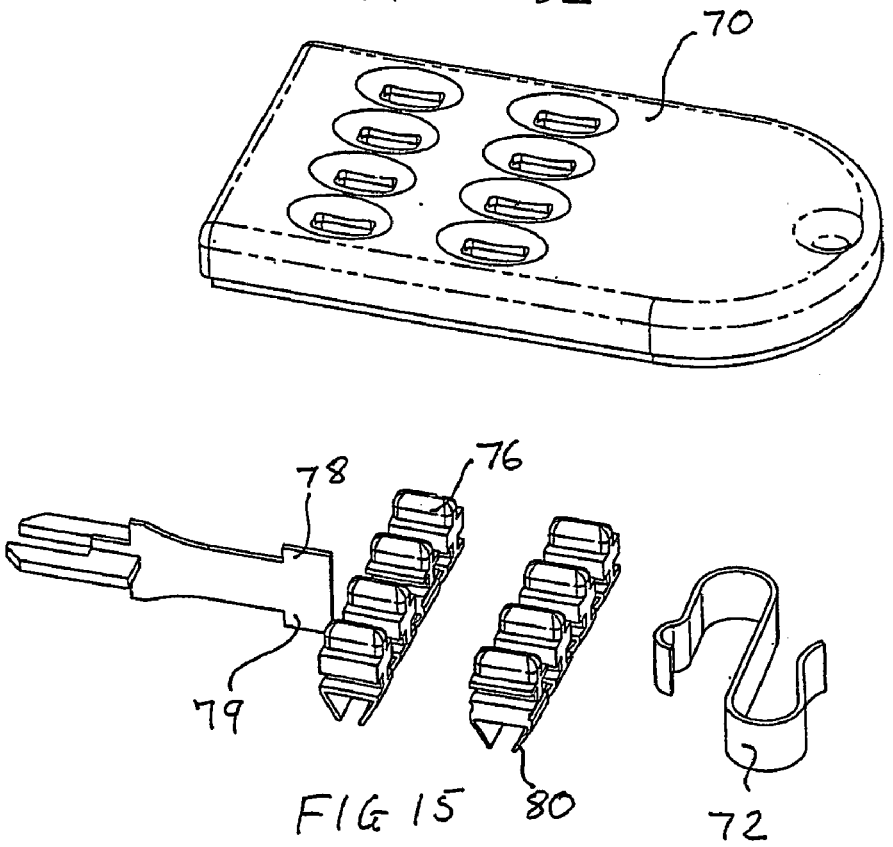
FIG. 15 is a further exploded view of the key of FIG. 12, with some components removed for clarity.

FIG. 15 illustrates a further disassembled view showing the form of the individual keys 76 which have respective angled resilient legs 80 which support each key on the interior of the lower housing in a resilient manner and biases each key to an upper position.

The arrangement of slots 75 is such that when any of the keys 76 apart from keys 76*a* and 76*b* are operated (see FIG. 13), they will interfere with motion of slide 74 into the retracted position and prevent it moving. Each of the keys 76 comprises a tip 80 and a solid central block 81 which when depressed prevents the slide member 74 from moving backwards. When a key is raised, however, the slots 75 are below the central block and side grooves 82 align with grooves in the slide and do not prevent its movement.

However, keys 76*a* and 76*b* include base blocks 83 and 71 which, with the keys in the upward position normally prevent movement of slide member 74. Only when keys 76*a* and 76*b* are depressed (and none of the other keys 76 are depressed) is the slide member 74 enabled to be moved to the retracted position.

It will be appreciated that one, two or more keys could arranged in the same manner as keys 76*a* and 76*b* to enable operation of the slide member 74 when they are depressed. With 8 keys a significant number of combinations can be created, sufficient to prevent somebody not having knowledge of the combination from being able to operate the key.

The fact that the key operates in a mechanical fashion and no electrical components are required, is advantageous, particularly where the key is mounted outside, as it must be rugged and resist all weather conditions. All components are preferably of plastics materials, in order to resist corrosion. Similarly, the majority of the components of the latch device may be of plastics apart from components which require particular strength, such as the magnetic bolt 6, any screws (not shown), and portions of the retaining member (eg magnet).

The above embodiment of the present invention is essentially a modification of the "vertical" latch device disclosed in the applicants' earlier US patent. The second operating mechanism, with push button, need not be used with a latch of this type. It could be used to operate any latch. Furthermore, the operating mechanism could be replaced with a remotely controlled electronic mechanism such as a solenoid.

Further, the security key described above need not even be used with latches, but could be used with any type of lock where it is convenient to provide security integral with the key.

It will be appreciated that other types of keys could be used, even keys with conventional locks. It will also be appreciated that other security means on the buttons themselves could actually be used eg a combination key pad.

The illustrated key could be arranged to be secured adjacent a latching device installation, for example having a tether connected to the base of the key and the forked tip being adapted to be secured in a suitable mounting bracket.

Although the latch in the above embodiment is a vertically displaced latch, other embodiments may have latches to be placed in any direction.

The invention claimed is:

1. A latching device for latching, in a predetermined position, two members which are otherwise moveable relative to one another, the latching device comprising:

a retaining element adapted to be mounted to a first of the members;

a mounting structure arranged to be mounted on a second of the members;

a latch arm mounted on the mounting structure and arranged in use, when in an engaged position, to engage with the retaining element to prevent relative movement of the members, the latch arm being displaceable to a disengaged position so that the members may be moved apart;

a first operating mechanism for displacing the latch arm to the disengaged position, the first operating mechanism including a first actuator manipulatable by a user to displace the latch arm to the disengaged position, the first actuator being positionable in use at a first height accessible by a standing adult user, and a second operating mechanism for displacing the latch arm to the disengaged position, the second operating mechanism including a second actuator manipulatable by an adult user to displace the latch arm to the disengaged position, the second actuator being positionable in use at a second height, lower than the first height, and accessible by a seated adult, such as a disabled person in a wheelchair, wherein the second actuator requires a key for operation, and wherein the second actuator includes a push button for operation.

2. A latching device in accordance with claim 1, wherein the second operating mechanism includes a locking mechanism which locks the push button in place preventing actuation until the key is used to release the locking mechanism.

3. A latching device in accordance with claim 2, wherein the key includes at least one prong arranged to fit into a corresponding groove in a keyhole in the pushbutton, pushing of the prong into the groove causing release of the locking mechanism so that the push button can be operated.

4. A latching device in accordance with claim 3, wherein the second operating mechanism includes a cam operably connected to the push button and a cam follower which is driven by the cam and the cam comprises angled ribs on a horizontally slideable plate element and the cam follower comprises complementary engagement means on a vertically displaceable element of the latch arm.

5. A latching device in accordance with claim 4, wherein the latch arm in use extends vertically and is arranged to be displaced in a vertical direction, and wherein the push button is arranged to be pushed inwardly in a horizontal direction, and the cam and the cam follower are arranged to displace the latch arm to raise it to the disengaged position.

6. A latching device in accordance with claim 1, wherein the second operating mechanism includes a further actuator, arranged to be positioned on the opposite side of the second member to that on which the second actuator is provided, whereby the second operating mechanism can be operated from either side of the second member.

7. A latching device in accordance with claim 2, wherein the key is arranged to be set normally to a disabled state where it cannot be used and capable of adult manipulation to an enabled state where it can be used, the key including a security means, operation which by adult manipulation sets the key to the enabled state.

8. A latching device in accordance with claim 7, wherein the security means includes a key pad adapted to be manipulated by an adult to set a code by way of the key pad to set the key in an enabled state.

9. A latching device in accordance with claim 7, wherein the security means includes a cover member in the disabled state, arranged to cover an operating element of the key, the cover member being adapted to be retracted to set the key in the enabled state.

10. A latching device in accordance with claim 1, wherein the mounting structure provides a housing and the latch arm is vertically displaceable against a downwardly directed force to the disengaged position, the first actuator being a grippable member.

11. A latching device in accordance with claim 10, wherein the retaining element has a magnet adapted to pull downwardly a steel bolt element of the latch arm, the latch arm having a spring biasing the bolt element upwardly to retain the bolt element in a retracted position when the members have been moved apart, the device being such that automatic locking of the bolt element occurs when the members are moved to a closed position.

12. A latching device in accordance with claim 1, wherein the second operating mechanism includes a further actuator, arranged to be positioned on the opposite side of the second member to that on which the second actuator is provided, whereby the second operating mechanism can be operated from either side of the second member, and the latch arm permits locking of one or more of the first operating mechanism, the first actuator and the second actuator, and any unlocked operating mechanism can be used by an adult to disengage the latching device.

13. A latching device for latching, in a predetermined position, two members which are otherwise moveable relative to one another, the latching device comprising:

a retaining element adapted to be mounted to a first of the members;

a mounting structure arranged to be mounted on a second of the members;

a latch arm mounted on the mounting structure and arranged in use, when in an engaged position, to engage with the retaining element to prevent relative movement of the members, the latch arm being displaceable to a disengaged position so that the members may be moved apart;

a first operating mechanism for displacing the latch arm to the disengaged position, the first operating mechanism including a first actuator manipulatable by a user to displace the latch arm to the disengaged position, the first actuator being positionable in use at a first height accessible by a standing adult user;

a second operating mechanism for displacing the latch arm to the disengaged position, the second operating mechanism including a second actuator manipulatable by an adult user to displace the latch arm to the disengaged position, the second actuator being positionable in use at a second height, lower than the first height, and accessible by a seated adult, such as a disabled person in a wheelchair;

the mounting structure including a connector operatively associated with the first and second operating mechanisms, and the connector and latch arm being arranged to be substantially vertically upward displaceable to permit unlatching and relative movement between the gate and gate post; and the second operating mechanism cooperates with the second actuator so that displacement of the second actuator is by motion in a substantial horizontal direction to cause displacement upwardly of the connector and latch arm.

14. A latching device in accordance with claim 13, wherein the second operating mechanism includes a push button actuator having an axis of actuation in a horizontal direction along which it is adapted to be pushed against biasing means to displace the latch arm and the connector substantially at right angles to the axis of actuation to the disengaged position, and wherein the second operating mechanism includes a cam element operated by the push button actuator, and a cam follower connected to the latch arm to displace it responsive to movement of the cam element.

15. A latching device in accordance with claim 14, and further comprising a locking mechanism adapted to be operated by an adult, which locks the push button actuator in a first position until the locking mechanism is released.

16. A latching device in accordance with claim 15, wherein the latch arm is arranged to be extended and retracted in a vertical direction to the engaged and disengaged positions, respectively, and wherein the push button is arranged to be pushed inwardly in a horizontal direction.

17. A latching device in accordance with claim 15 and further comprising a key arranged to operate the locking mechanism to release the locking mechanism.

18. A latching device in accordance with claim 17, wherein the key includes at least one prong arranged to fit into a corresponding groove in a keyhole in the push button, pushing of the prong into the groove causing release of the locking mechanism so that the push button can be operated.

19. A latching device in accordance with claim 14, wherein the operating mechanism provides a further push button actuator, arranged to be position on the opposite side of the first member to the first push button actuator, whereby the operating mechanism can be operated from either side of the first member.

20. A latching device in accordance with claim 19, wherein a horizontally displaceable cam element is associated with each push button actuator so that either cam element can be pushed inwardly and then engage the cam follower to displace the latch arm vertically and irrespective of whether the other push button actuator may be locked.

21. A latching device in accordance with claim 17 wherein the key is arranged to be normally set to a disabled state where it cannot be used and capable of adult manipulation to an enabled state where it can be used, the key including a security means, operation of which by adult manipulation sets the key to the enabled state.

22. A latching device in accordance with claim 21, wherein the security means includes a key pad adapted to be manipulated by an adult to set a code by way of the key pad to set the key in an enabled state.

23. A latching device in accordance with claim 22, wherein the security means includes a cover member in the disabled state, arranged to cover an operating element of the key, the cover member being adapted to be retracted to set the key in the enabled state.

24. A latching device as claimed in claim 13, wherein the latch arm has a steel projecting element arranged for engagement in a retaining element having a magnet for holding the projecting element when in a latching position.

25. A latching device as claimed in claim 13, wherein the connector includes a lost motion interconnection with the first actuator.

26. A key for operating a locking mechanism, wherein the key is arranged to be normally set to a disabled state where it cannot be used and capable of adult manipulation to an enabled state where it can be used, the key including a security means, operation of which by adult manipulation sets the key to the enabled state.

27. A key in accordance with claim 26, wherein the security means includes a key pad adapted to be manipulated by an adult to set a code by way of the key pad to set the key in an enabled state.

28. A key in accordance with claim 26, wherein the security means includes a cover member in the disabled state, arranged to cover an operating element of the key, the cover member being adapted to be retracted to set the key in the enabled state.

29. A key in accordance with claim 26, wherein the key has at least one shaped elongate finger for unlocking a locking mechanism by insertion axially along the axis of elongation of the finger.

30. A key in accordance with claim 29, wherein at least two spaced prongs provide the elongate finger to provide a transportable, adult useable key for releasing a child restraint lock device.

* * * * *